US006179014B1

(12) United States Patent
Shaw

(10) Patent No.: US 6,179,014 B1
(45) Date of Patent: Jan. 30, 2001

(54) DRAWING GRIPPER FOR A RAPIER LOOM FOR RECEIVING AND POSITIONING A FILLING TO BE INSERTED INTO A LOOM SHED

(75) Inventor: Henry Shaw, Steenvoorde (FR)

(73) Assignee: Picanol N.V., Ypres (BE)

( * ) Notice: Under 35 U.S.C. 154(b), the term of this patent shall be extended for 0 days.

(21) Appl. No.: 09/147,347

(22) PCT Filed: Jun. 7, 1997

(86) PCT No.: PCT/EP97/02973

§ 371 Date: Dec. 7, 1998

§ 102(e) Date: Dec. 7, 1998

(87) PCT Pub. No.: WO97/47792

PCT Pub. Date: Dec. 18, 1997

(30) Foreign Application Priority Data

Jun. 7, 1996 (BE) ..... 9600520
Mar. 11, 1997 (BE) ..... 9700210

(51) Int. Cl.[7] ..... D03D 47/20; D03D 47/34; D03D 47/23

(52) U.S. Cl. ..... 139/448

(58) Field of Search ..... 139/448, 438

(56) References Cited

U.S. PATENT DOCUMENTS 5,129,431 * 7/1992 Stacher ..... 139/448
5,819,812 * 10/1998 Bortoli et al. ..... 139/448
5,899,242 * 5/1999 Egloff ..... 139/448

* cited by examiner

*Primary Examiner*—Andy Falk
(74) *Attorney, Agent, or Firm*—Bacon & Thomas, PLLC

(57) ABSTRACT

A gripper-loom drawing gripper for receiving a yarn supplied by a yarn feeder and resting on a deflection guide, the gripper serving to position the yarn and carry it into the shed. The drawing gripper is configured to define a longitudinal cavity extending from its forward end facing a filling to be received and positioned by the gripper to its opposed rearward end. The cavity of the gripper faces towards and partially encloses the deflection guide. The forward tip of the gripper includes an inclined surface for guiding a filling to a positioning device on the gripper, and a yarn clamp is also carried by the gripper. The gripper includes additional receiving and positioning devices for a filling to be inserted in the loom shed.

21 Claims, 16 Drawing Sheets

FIG. 3
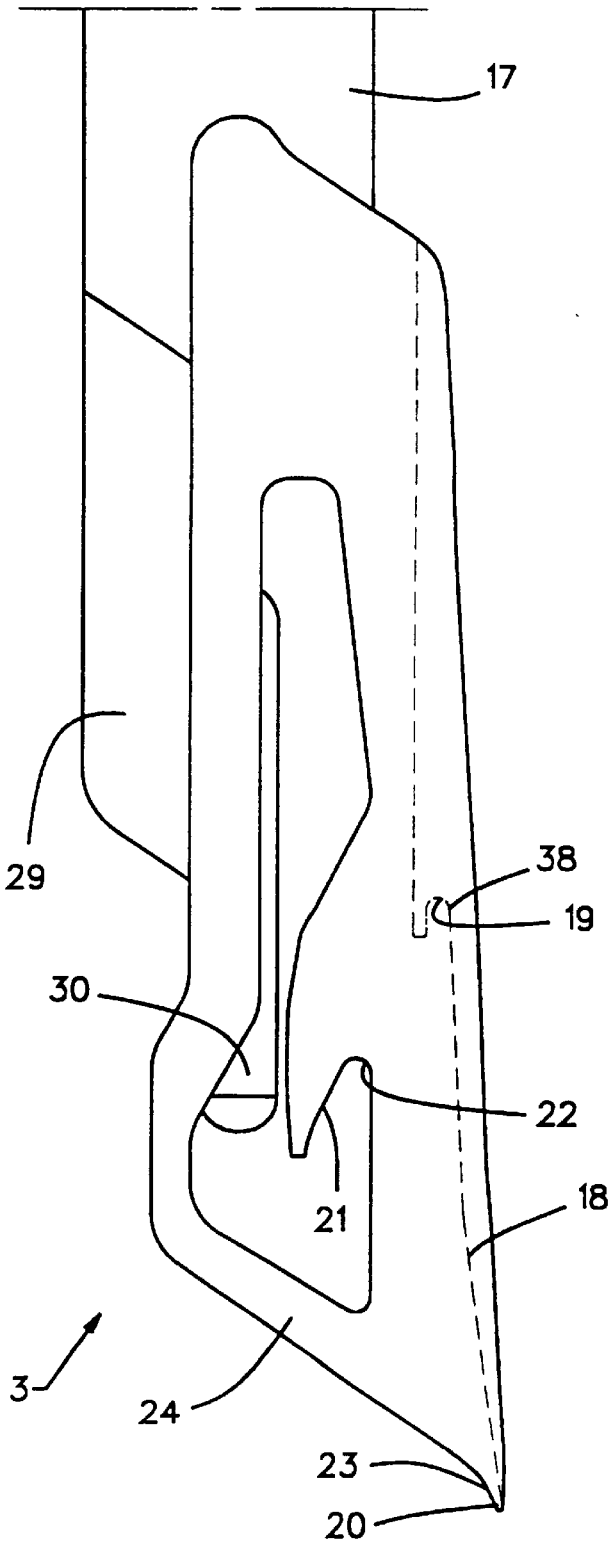
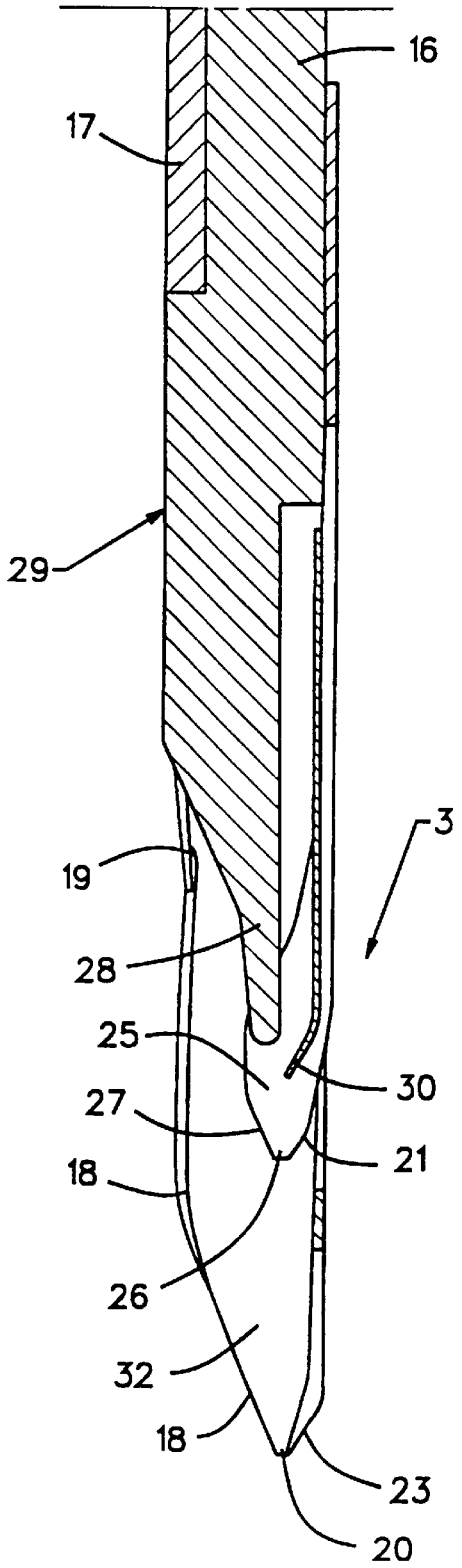
FIG. 4

DRAWING GRIPPER FOR A RAPIER LOOM FOR RECEIVING AND POSITIONING A FILLING TO BE INSERTED INTO A LOOM SHED

BACKGROUND OF THE INVENTION

1. Field of the Invention

The invention relates to a drawing gripper for a rapier loom fitted with means to receive and to position a filling yarn kept in readiness and resting on a deflection guide.

2. Related Art

In rapier looms, a filling yarn is conventionally made to pass through the shed using a drawing gripper and a receiving gripper. The drawing gripper receives a filling at the intake side of the shed, this filling being kept in readiness by a yarn feeder. When the drawing gripper is being introduced into the shed, the filling is received and positioned inside this drawing gripper and clamped by a clamp. At the approximate middle of the shed, the filling is transferred to a receiving gripper, then clamped by a receiving-gripper clamp and moved by the receiving gripper to the other side of the shed. Meantime the empty drawing gripper returns to its initial position in front of the shed's intake side.

It is furthermore known with respect to rapier looms to move a filling by means of a single drawing gripper through the entire shed. In this case the drawing gripper receiving the filling at the shed's intake side moves toward the opposite shed side where the filling then is released to a receiving hook or the like.

It is known from the U.S. Pat. No. 4,653,544 to make the feeder deposit the filling on a deflecting means in such manner that this filling is kept in a defined position whereat it can be reliably picked up by the drawing gripper when latter is moving toward the shed.

It is known from the European patent document 0 509 255 A1 to fit a drawing gripper (starting at its tip) with a guide surface leading to a transverse slot into which the filling to be received drops. Once the filling has been dropped into this slot, it is no longer able to slip out of it. However only those fillings may be used in weaving that shall easily slip through the slot, so that thick fillings or reinforced fillings cannot be woven at all or only with difficulty. This design has another drawback in that the filling to be received loses all its tension when dropped into the slot and then will remain wholly slack. If the filling positioned inside the drawing gripper is subsequently tensioned by the motion of the drawing gripper, then the load will be applied abruptly. The danger of filling rupture is enhanced thereby.

It is furthermore known from the European patent document 0 441 099 A1 to use a substantially U-shaped plate as the drawing gripper. The crossbar of this U-shaped plate acts as a slide surface for the warp yarns of a lower shed. The leg facing the fabric edge forms a guide surface for the filling to be received and directly guides the filling to a clamp entered by said filling. The other leg also comprises a guide surface and a clearance acting as a positioning device. This design entails the risk that the guide surface of the crossbar facing the fabric edge shall catch a warp moving slightly off-path and shall feed it to the gripper clamp. Warp rupture then inevitably results.

The objective of the invention is to so design a drawing gripper of the above-mentioned kind such that a filling kept in readiness shall be reliably seized and the danger of gripping a warp is substantially reduced.

SUMMARY OF THE INVENTION

This problem is solved in that the drawing gripper subtends a longitudinal cavity which is open both at the front and at the rear and furthermore on the side facing the deflecting element which it encloses.

A readied filling which on account of deflected guidance follows a path clearly different from one that might be followed by a warp can be properly seized by the drawing gripper of the invention and can be reliably received in said gripper. On the other hand there is little risk that the drawing gripper should catch a warp off its proper path. Moreover limitations regarding the dimensions of a filling to be received are absent from the design of the invention.

In the design of the invention, the elements receiving a filling are mounted in various walls of the cavity. As a result, when carried along by the drawing gripper, the filling tension is increased stepwise and the danger of filling rupture is restricted.

In another embodiment of the invention, positioning devices are mounted in two different cavity walls and are mutually separate and opposed. As a result, the drawing gripper keeps a free filling segment in its cavity and hence the segment can be very easily transferred to a receiving gripper or a receiving hook.

In a further example of the invention, the elements receiving, and/or the devices positioning, in the direction of motion of the drawing gripper relative to the position of the readied filling, are offset relative to one another. As a result, the filling tension is raised stepwise when the filling is moved by the drawing gripper and the danger of filling rupture is restricted even further.

The invention provides that the receiving element is fitted with a lip projecting into the drawing gripper and is associated with the positioning device, which in turn is associated with the edge of a fabric being woven, whereby said lip forms a guide surface leading to the positioning device. The drawing gripper side facing the edge of a fabric being woven is at greater risk as regards unwanted pickup of a warp. Because the receiving element, namely the lip, enters the drawing gripper, possible contact between this lip with a warp is substantially precluded.

In another example of the invention, a yarn clamp is present inside the drawing gripper and is mounted at the fabric edge side of the positioning device. This configuration assures that the yarn clamp only will clamp the received filling, and will not be used for any positioning. Accordingly the filling position is defined solely by the positioning device and this filling will always be at the same location and thereby can be reliably transferred to a receiving gripper or receiving hook.

In a further example of the invention, the drawing gripper consists of a substantially U-shaped plate which, as seen in the direction of motion of the drawing gripper, comprises a leg located above the deflection guide and a leg located to the side of the deflection guide. Advantageously in this example, the receiving elements, when viewed in the direction of motion of the drawing gripper, will be configured on opposite sides of the deflection device.

In a further embodiment of the invention, the drawing gripper is fitted with a slide surface associated with guide means guiding a drawing gripper support and/or a gripper band support. This feature enables direct guidance and support of the drawing gripper inside the shed.

Further features and advantages of the invention are elucidated in the following description of illustrative embodiments shown in the drawings.

BRIEF DESCRIPTION OF THE DRAWINGS

FIG. 3 is a topview of the cutaway of FIGS. 1 and 2 in the direction of arrow F3 in FIG. 2, FIG. 4 is a section along the line IV—IV of FIG. 2.

DETAILED DESCRIPTION OF PREFERRED EMBODIMENTS OF THE INVENTION

Figure 1:
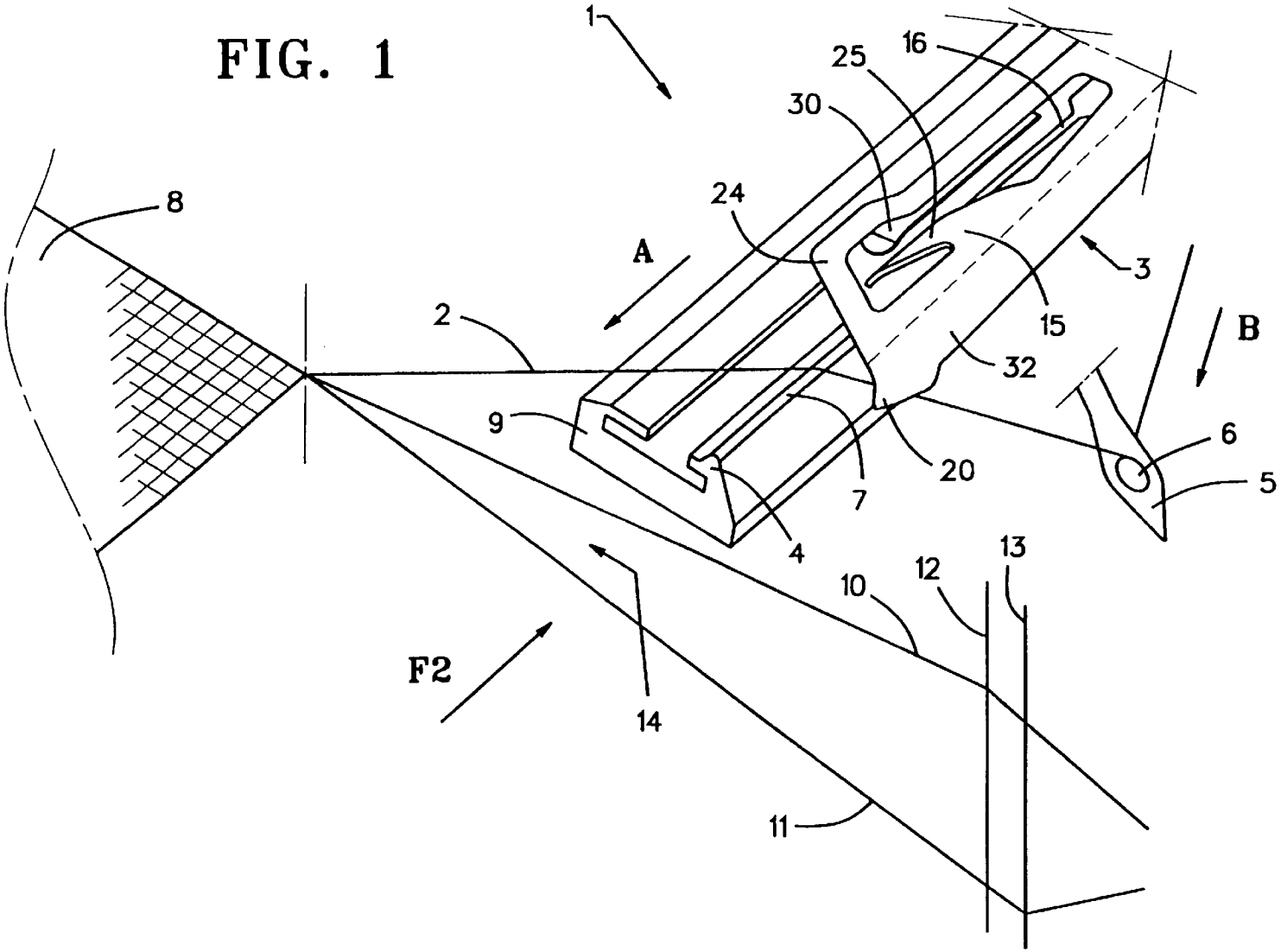
FIG. 1 is a cutaway perspective of a rapier loom with a drawing gripper of the invention.

The system 1 shown in FIG. 1, used in a rapier loom to insert a filling 2, comprises a drawing gripper 3 and a deflection guide 4. The filling 2 to be fed runs from the edge of a fabric 8 through a yarn guide eye 6 of a yarn feeder 5 to a yarn supply (not shown). The filling 2 runs from the yarn supply in the direction B to the yarn feeder 5. The yarn feeder illustratively may be a component of the yarn feed system according to U.S. Pat. No. 5,400,834 and places the filling 2 on the deflection guide 4 in such manner that the drawing gripper 3, which moves in its direction of motion A, shall receive the filling which shall be positioned inside the drawing gripper, be clamped and then be carried along.

The deflection guide 4 in this embodiment is part of guide channel 9 guiding a gripper band 17 (see FIG. 3), the drawing gripper 3 being affixed to a support 16 in turn mounted on the rapier band 17 (FIG. 4). FIG. 1 furthermore shows warps 10, 11 of a warp sheet, also shed-forming means 12, 13 forming a shed 14 from the warps 10, 11. For the sake of clarity, a batten with reed, present between the fabric 8 and the shed-forming means 12, 13, have been omitted.

Figure 2:
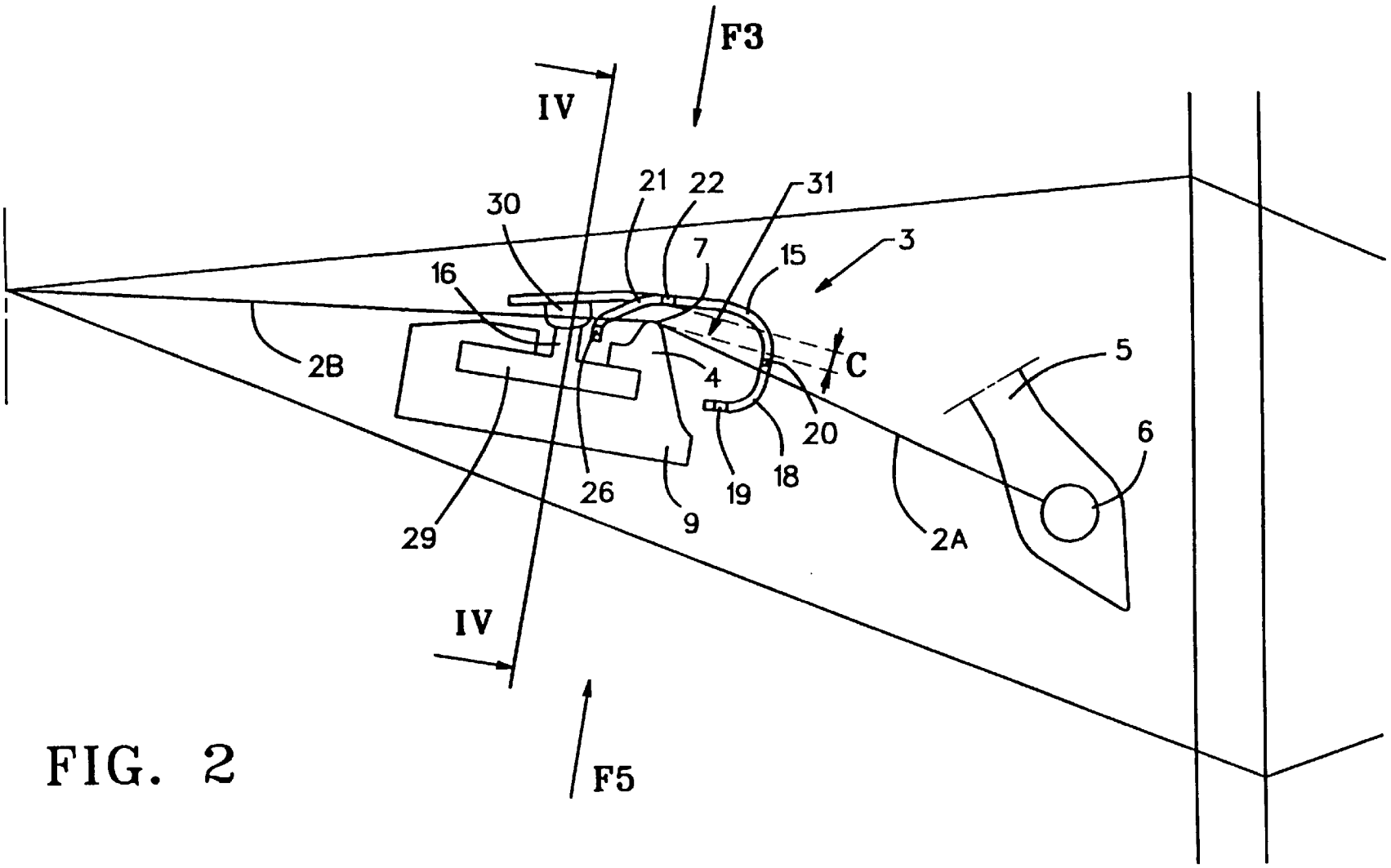
FIG. 2 is an elevation of FIG. 1 in the direction of arrow F2 of FIG. 1.
Figure 5:
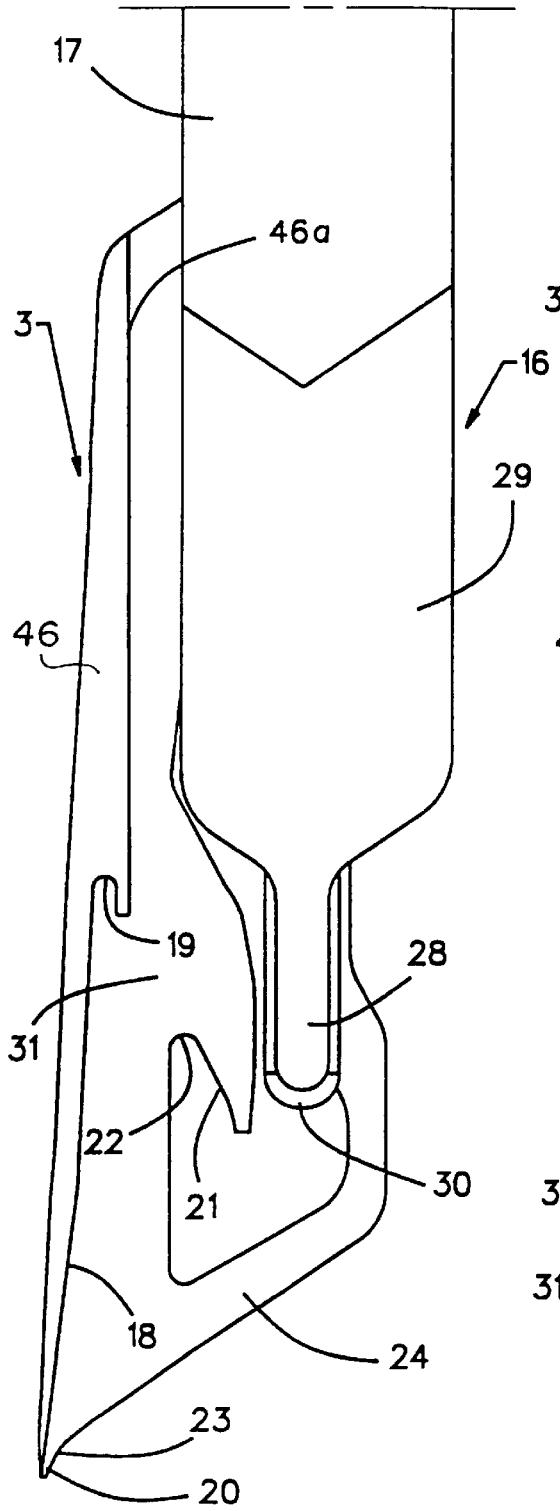
FIG. 5 is a view from below of the cutaway of FIG. 2 in the direction of arrow F5.

The view of FIG. 2 shows the drawing-gripper position relative to the deflection guide 4. The filling 2 runs from the yarn guide eye 6 over the deflecting edge 7 of the deflection guide 4 to the edge of the fabric 8, the previously fed filling following reed beatup remaining connected to said fabric.

As shown by FIGS. 1 through 5, the drawing gripper 3 essentially consists of a bent plate 15, in particular made of high-grade steel or aluminum, which is connected by a support 16 to a rapier band 17. The plate 15 is cross-sectionally bent into a U-shape including top longer leg or wall 24, side leg or cross bar 32 and a shorter bottom or lower leg 46 (FIG. 5), whereby the walls subtend or define a cavity 31 stretching in the longitudinal direction of the drawing gripper 3. This cavity 31 is open at the front and rear ends of the drawing gripper 3 and toward the deflection guide 4 as elucidated further below. As shown by FIG. 1 the U-shaped plate 15 comprises one long leg 24 mounted above the deflection guide 4 and one shorter leg 15 to the side of the deflection guide 4. As elucidated below, the drawing gripper is fitted with elements to receive the filling 2, with devices to position the filling 2 inside the drawing gripper 3 and with means to carry along or to clamp the received filling. The front end of the drawing gripper 3 substantially consists only of the crossbar 32 that extends forwardly of longer leg 24 and tapers in wedge-manner into a tip 20 as shown especially clearly in FIG. 4. The beginning of the longer leg 24 is located shortly behind the tip 20, its size increasing from the tip backward. The oblique lower side of the crossbar 32 together with the short bottom leg 46 beginning at a distance from the tip 20 forms a seat 18 for receiving and guiding the filling. The filling 2 slides downward on this seat 18 (FIG. 2) and then arrives at a clearance 19 in the short bottom leg 46 acting as a positioning device. When the drawing gripper 3 is displaced along its direction of motion A toward the shed 14, the seat 18 first moves against the filling 2 and guides this filling into the clearance 19 acting as a positioning device. As shown by FIG. 2, the guide surface beginning underneath the tip 20 and acting as a seat 18 is first to move against the segment 2A of the filling 2 running from the deflection edge 7 to the yarn feed device 5. This segment 2A of the filling therefore is impacted first and guided into the clearance 19 acting as the positioning device.

Figure 7:
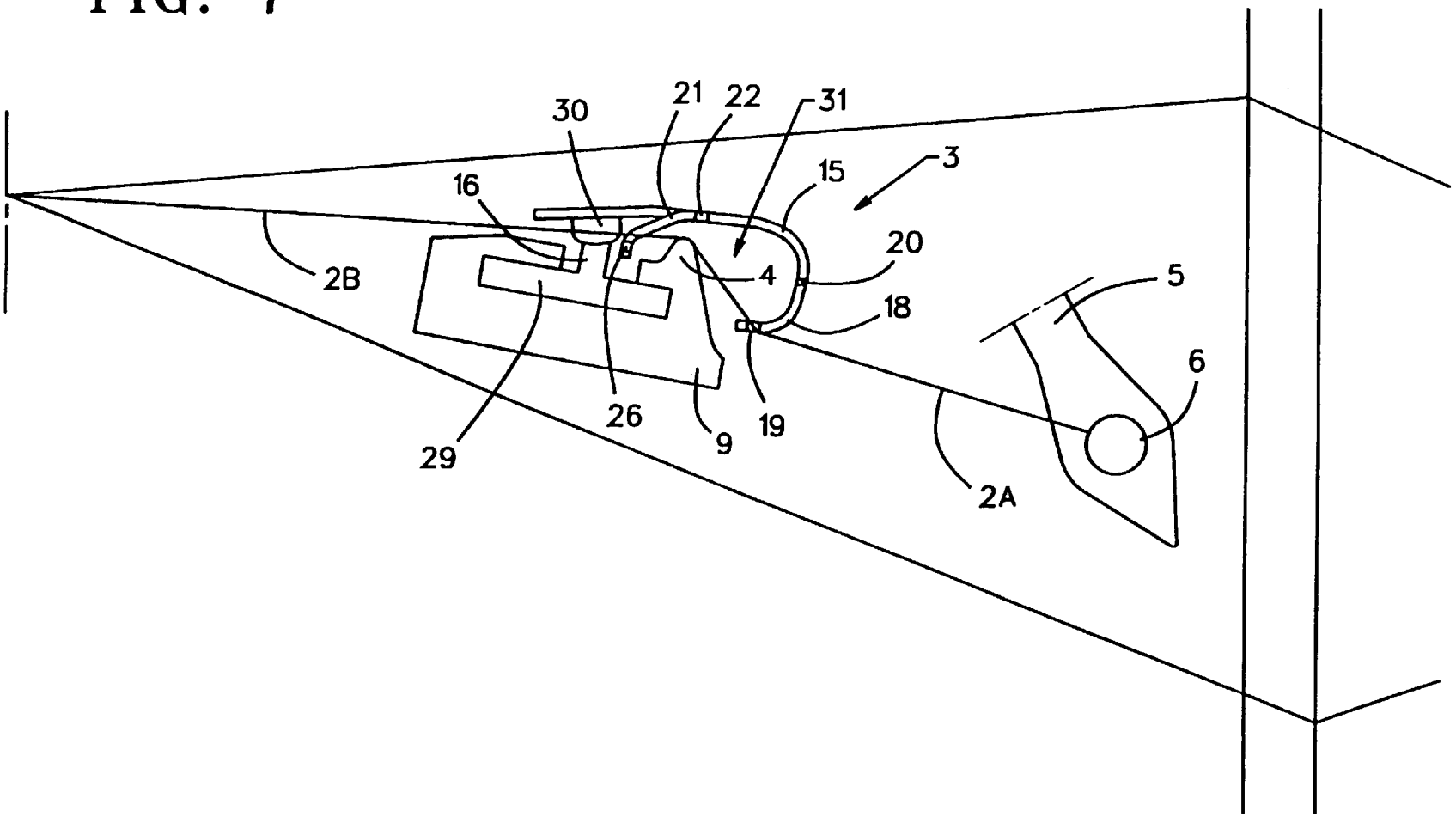
FIG. 7 is a view of the cutaway of FIG. 6 in the direction of arrow F7 of FIG. 6.
Figure 8:
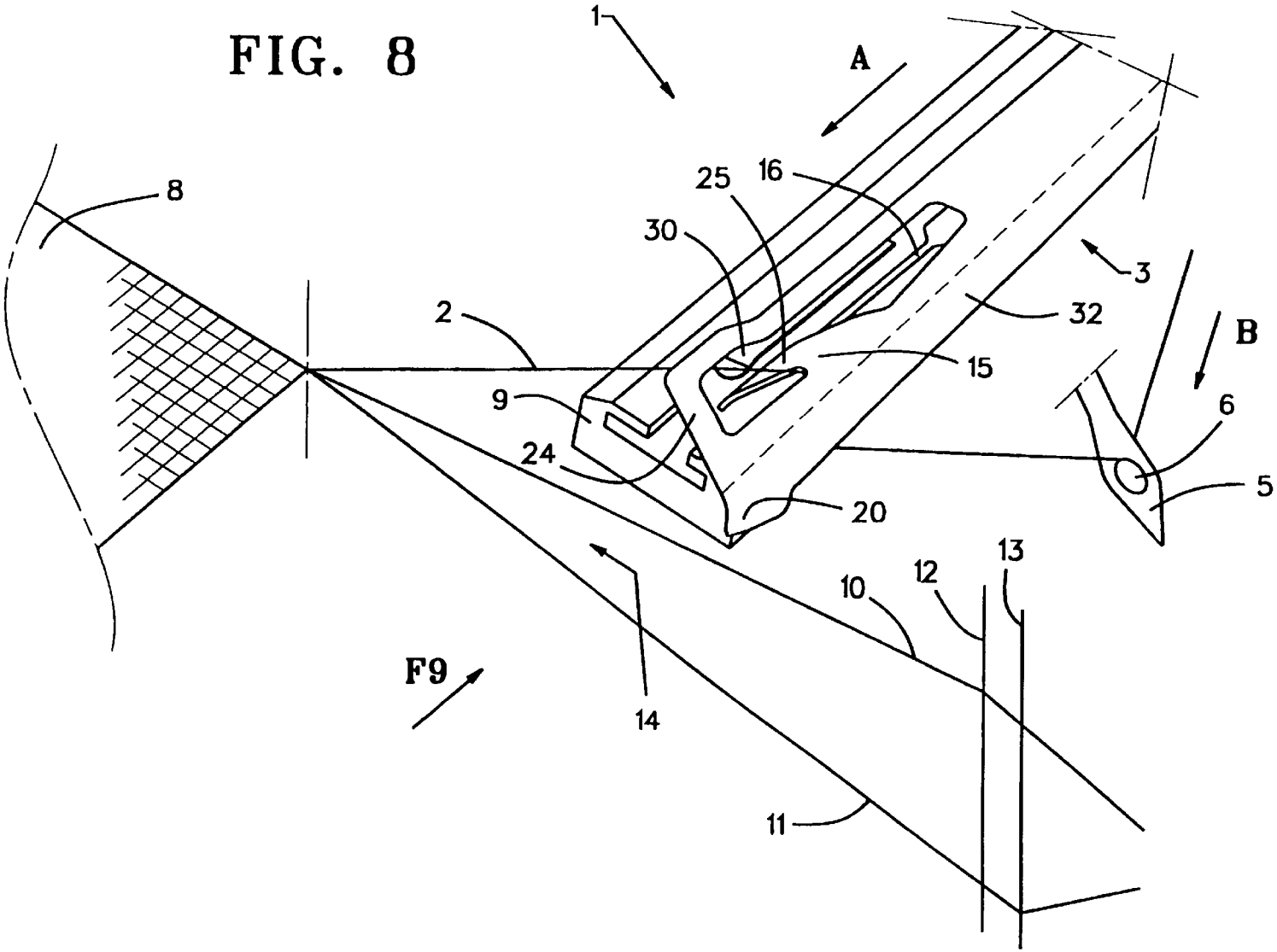
FIG. 8 is a perspective similar to those of FIGS. 1 and 6 in a drawing gripper position which is even more advanced.
Figure 9:
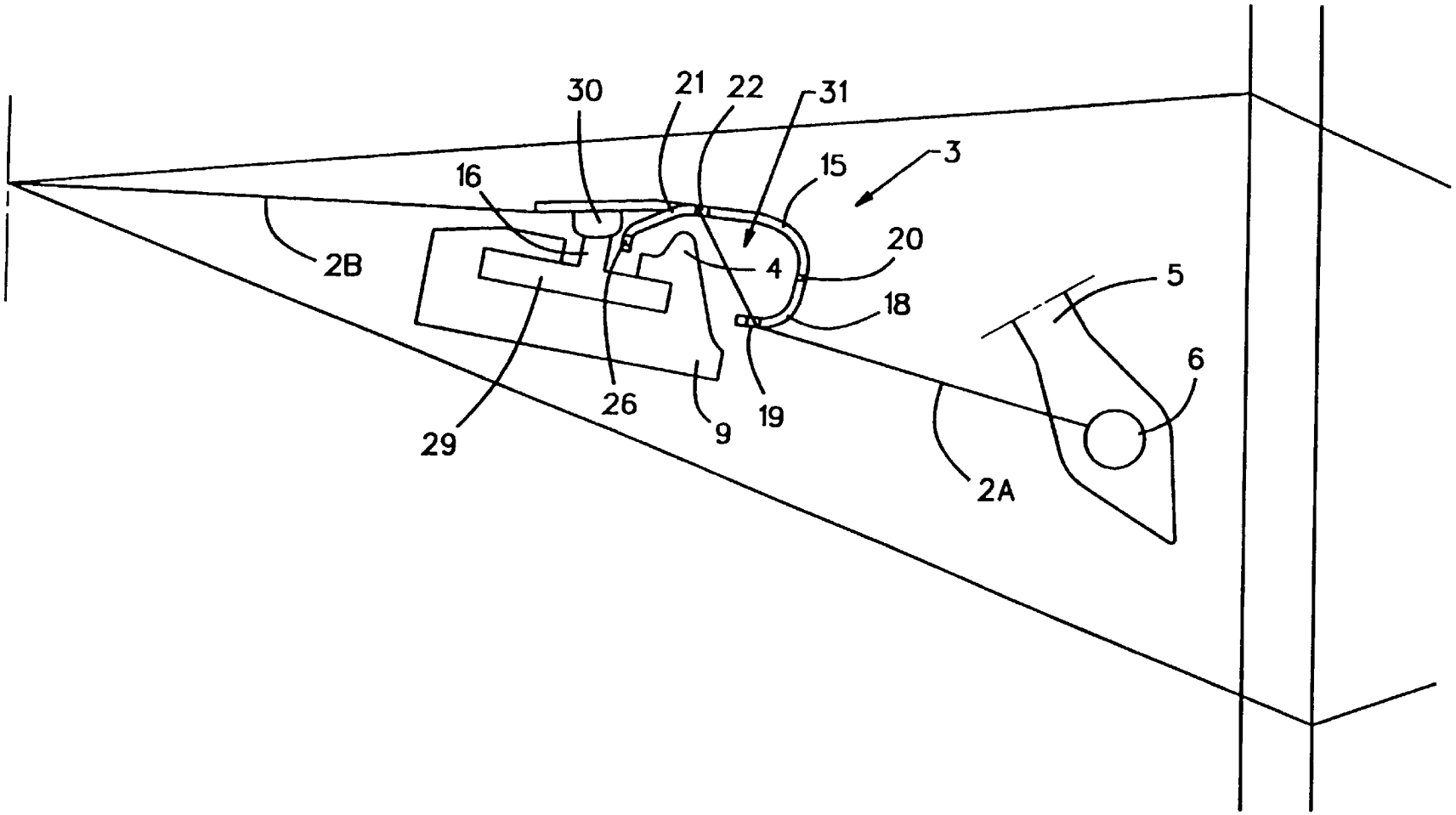
FIG. 9 is a view in the direction of arrow F9 of FIG. 8.
Figure 10:
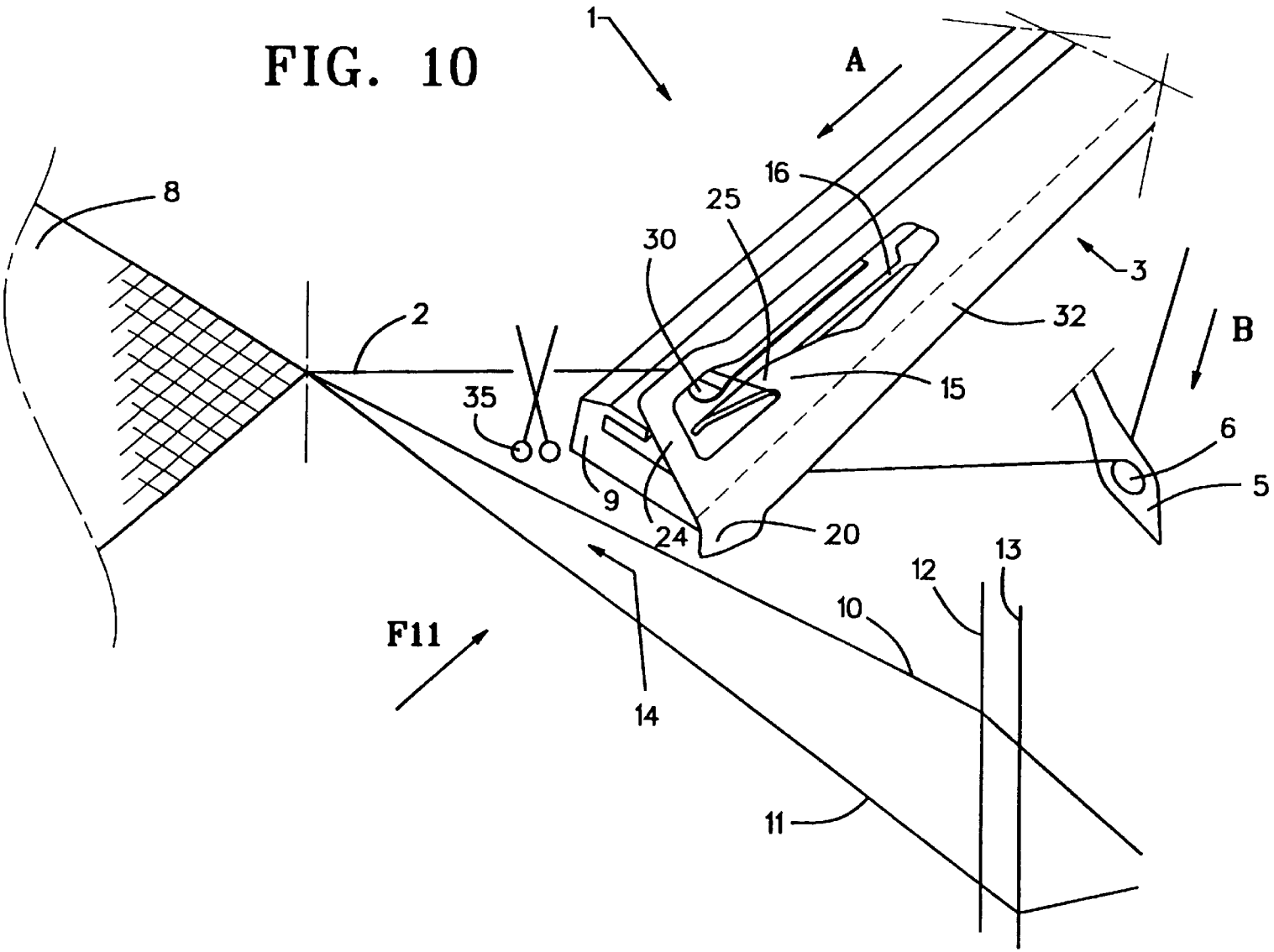
FIG. 10 is a perspective view of the cutaway of FIGS. 1, 6 and 8 in a still further advanced position of the drawing gripper.

An inwardly bent lip 25 is cut out of the long leg 24 of the U-shaped plate and constitutes a second receiving element for the filling 2. This lip 25 runs obliquely inwardly of the cavity forward and, adjoining an approximately wedge-shaped tip 26, forms a guide surface 21 guiding the filling obliquely upward into the plane of the long leg 24 to a clearance 22 therein acting as a second positioning device. As shown by FIGS. 2 and 7, this lip 25 acting as a receiving element seizes the filling segment 2B present between the deflecting edge 7 and the edge of the fabric 8. The edge 27 running downward from the tip 26 of the lip 25 constitutes an oblique guide butting against a strip 28 of the support 16 running obliquely to the foot 29 of the support 16 constituting an extension of the rapier band 17. As seen in FIG. 2, the tip 26 of lip 25 extends inwardly over the deflection guide surface 7 on the side of the guide surface closer to the edge of fabric 8 being woven.

The drawing gripper 3 furthermore comprises a yarn clamp 30 mounted on the inside of the long leg 24 of the plate 15. The yarn clamp 30 is present at a site between the guide surface 21 of the lip 25 and the fabric 8. In this embodiment the yarn clamp 30 consists of a leaf spring running in the direction of motion A of the drawing gripper and mounted inward at the underside of the plate 15. The yarn clamp 30 cooperates with the inside of the plate 15. The lip 25, which acts as a receiving element, also guides the filling segment 2B to the yarn clamp 30.

As shown by FIG. 4, the drawing gripper 3 is configured in such manner that, beginning at the tip, its height continuously increases toward the rapier band 17, thereby precluding any location which might catch warps 10, 11. Starting from the tip, besides the presence of the seat 18, there is also a guide surface 23 leading to the upper leg 24 of the plate 15. Again warps 10, 11 cannot catch between the yarn clamp 30 and the plate 15. The tip 26 of the lip 25 as viewed in the direction of motion A is a safe distance from the tip 20 of the drawing gripper 3 formed by the crossbar 32 of the U-shaped plate 15. The height of the crossbar 32 in the vicinity of the tip 26 of the lip 25 is such that the warps separated from the lip cannot be seized by the lip 25. Any warp at all entering this zone will be deflected from the guide edges 27 and 28 toward the base 29 of the support 16. While the tip 26 of the lip 25 does enter the cavity 31, as shown in particular in FIG. 4, it does so only to an extent which is less than half the height of the crossbar 32.

To facilitate weaving fillings 2 of almost any arbitrary thickness, the distance C of FIG. 2 between the inside of the long leg 24 of the plate 15 and the deflecting edge 7 of the deflecting element 4 is at least 2 mm, preferably between 3 and 5 mm.

As shown for instance in FIG. 2, the deflecting edge 7 of the deflection guide 4 of the filling 2 enters the cavity 31 subtended by the plate 15 in such manner that the elements receiving the filling 2, that is the guide 18 starting at the tip 20 of the crossbar 32 and the guide 21 starting at the tip 26 of the lip 25, are each located on opposite sides of the deflecting edge 7. The cavity 31 being open at the front and rear, the drawing gripper 3 can move unimpeded along the deflection guide 4.

FIGS. 6 through 11 show that the guide 18 acting as a seat and adjoining the crossbar tip 20 first seizes the segment 2A of the filling 2 in readiness running from the deflection edge 7 to the guide eye 6 of the yarn feeder 5. The filling 2 is deflected downward until the filling arrives into the clearance 19 of the short leg acting as a positioning device. Thereupon the lip 25 acting as a seat seizes, above its tip 26 and by means of the guide surface 21, the segment 2B of the filling 2 which runs from the edge of the fabric 8 to the deflecting edge 7.

Figure 11:
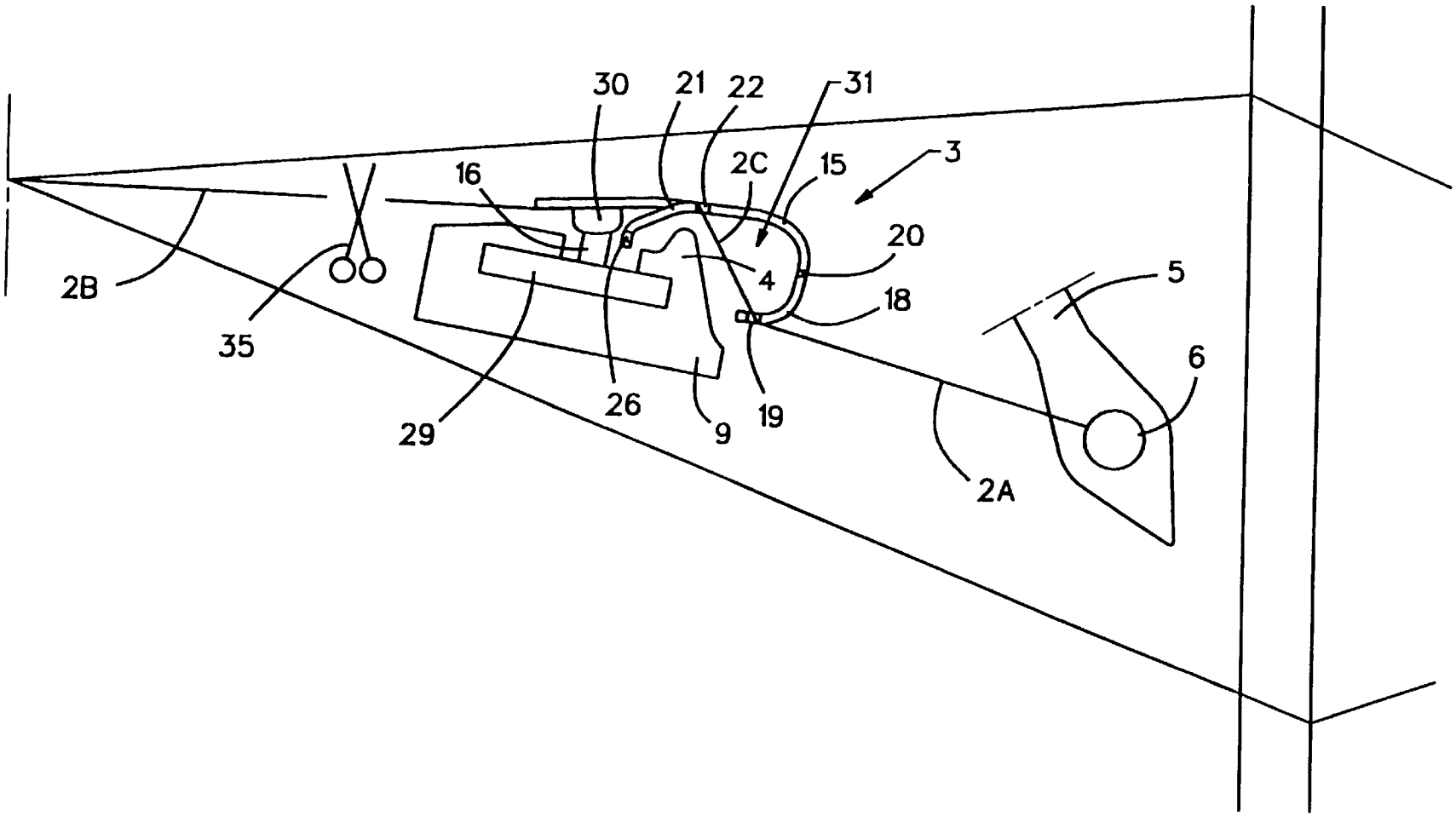
FIG. 11 is a view in the direction of arrow F11 of FIG. 10.

In this process and as shown by FIGS. 8 through 11, upon further forward displacement of the drawing gripper 3 in the direction A, the filling 2 is lifted off the deflecting edge 7 and arrives into the clearance 22 acting as a positioning device and into the yarn clamp 30. Thereupon the filling is cut by means of beater cutters 35 schematically indicated in FIGS. 10 and 11 in the region between the yarn clamp 30 and the fabric 8. FIG. 11 shows that a segment 2C of the filling 2 rests freely inside the cavity 31 between the position-determining clearances 19, 22, that is at a defined location, where it can be reliably transferred to a receiving gripper or a receiving hook.

Illustratively and as shown in FIG. 1, the readied filling runs obliquely from the edge of fabric 8 to the yarn feeder 5 over the deflection edge 7, that is obliquely to the direction of motion A of the drawing gripper 3, away from the fabric 8. When the filling 2 is seated and positioned inside the drawing gripper 3, this drawing gripper is displaced in this direction of motion A along the deflecting edge 7 which must be commensurately long in the direction of motion A. Because the filling 2 is consecutively both seated by the guide surfaces 18 and 21 and positioned in the clearances 19 and 22 and also moved into the filling clamp 30, the filling tension is increased stepwise and thereby the risk of filling rupture is decreased. The tension in the filling 2 will be increased when this filling 2 is stretched due to being guided along the guide surfaces 18 and 21 and/or on the deflection edge.

Several yarn feeders 5 are used in practice, each being able to keep in readiness one filling 2 of the same type to be seated or of different types on the deflection guide 4 and carried by the drawing gripper 3. It would be intrinsically advantageous that the yarn feeders deposit each particular filling each time in the same position on the deflection guide 4. In the light of the drawing gripper geometry however, deviations of direction are allowable in which the various fillings 2 starting from the edge of the fabric 8 toward the yarn feeder 5 are deposited on the deflection edge 7. Care need only be paid that the yarn feeder 5 be moved to a height wherein the filling segment 2A is located underneath the tip 20 of the crossbar 32 of the U-shaped plate 15 and the segment 2B of the filling 2 is located above the tip 26 of the lip 25. As a result the particular filling 2 undergoes a stepwise increase in tension.

Figure 12:
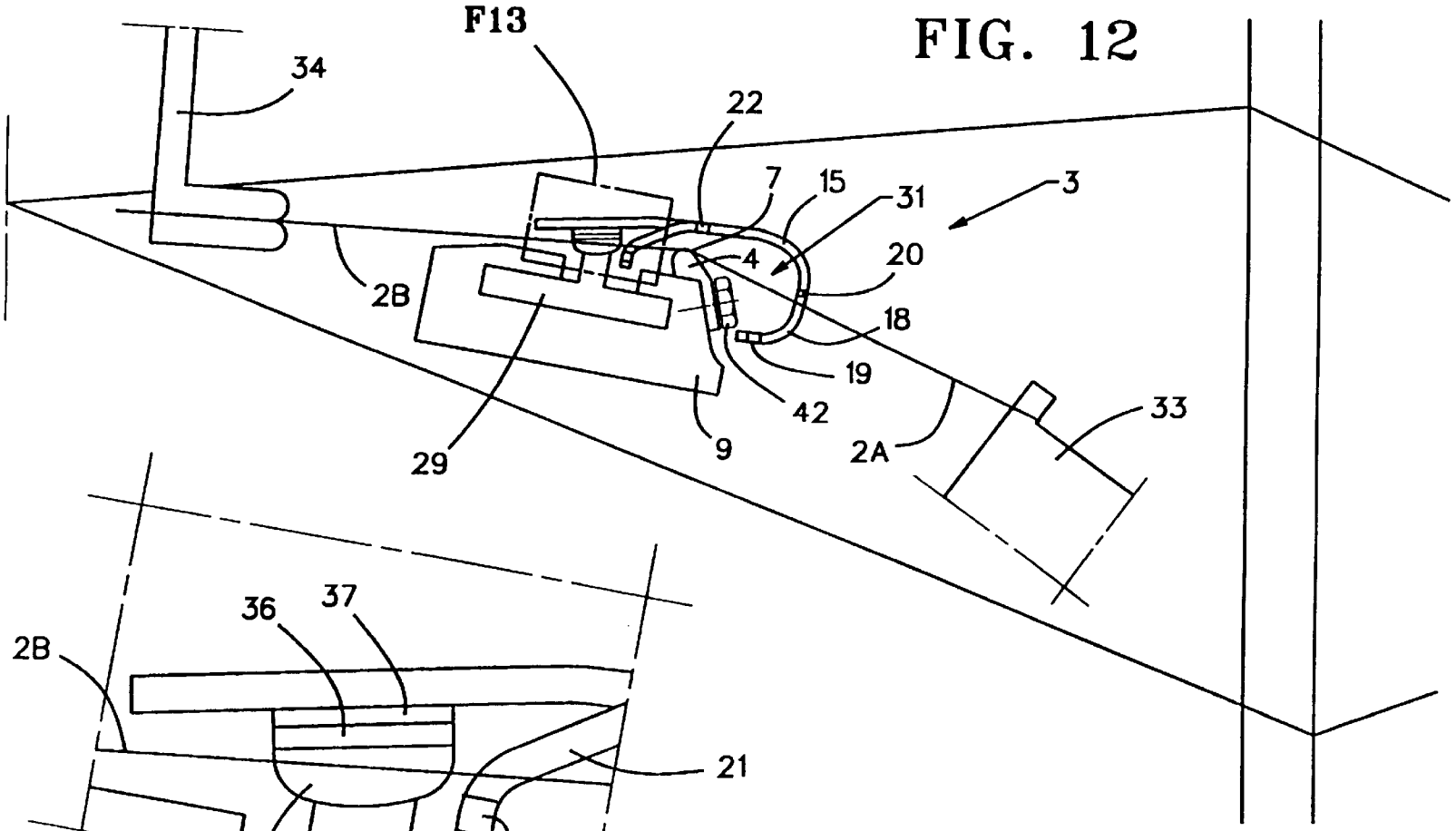
FIG. 12 is a view similar to that of FIG. 2 of an embodiment variation.

In an embodiment variation relative to that shown in FIGS. 1 through 11, it is clear that the filling 2 need not be kept necessarily ready between a yarn feeder 5 and the fabric 8. FIG. 12 for instance shows an embodiment wherein a filling 2 is kept ready by a feed guide component 33 affixed to a loom's batten in the manner disclosed in U.S. Pat. No. 4,840,203. The filling 2 is delivered by a feed clamp 34 within the vicinity of the fabric 8 and this clamp is driven by a mechanism disclosed in this U.S. Pat. No. 4,840,203. However the filling 2 is also guided in such manner over a deflection edge 7 of a deflection element 4 that it will be situated in the above-described manner in the region of the cavity 31 of the drawing gripper 3, whereby it can be received by the drawing gripper 3 while being under stepwise increasing tension when said gripper is moving in the direction A toward the shed.

Figure 13:
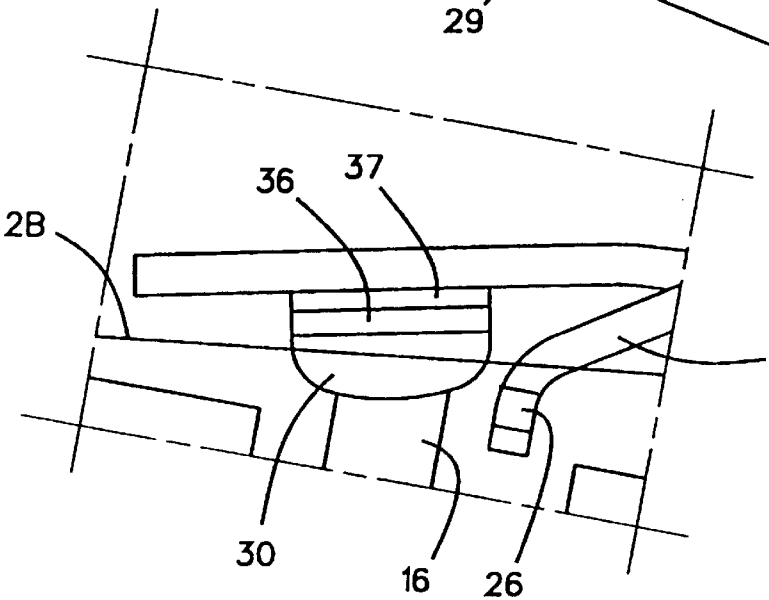
FIG. 13 is an enlargement of the cutaway F13 of FIG. 12.

As regards the embodiment of FIGS. 12 and 13, furthermore, the filling is not directly clamped by the yarn clamp 30 at the underside of the plate 15. Instead a metallic spacer 36 is provided which is affixed by one or more elastic elements 37 to the plate 15. Illustratively the elastic elements 37 are made of elastomeric laminate and damping material. In this embodiment, moreover, the deflection guide 4 with the deflecting edge 7 is not integral with the guide channel 9 but rather is a separate component and is affixed by screws 42 or the like to the guide channel 9.

Figure 16:
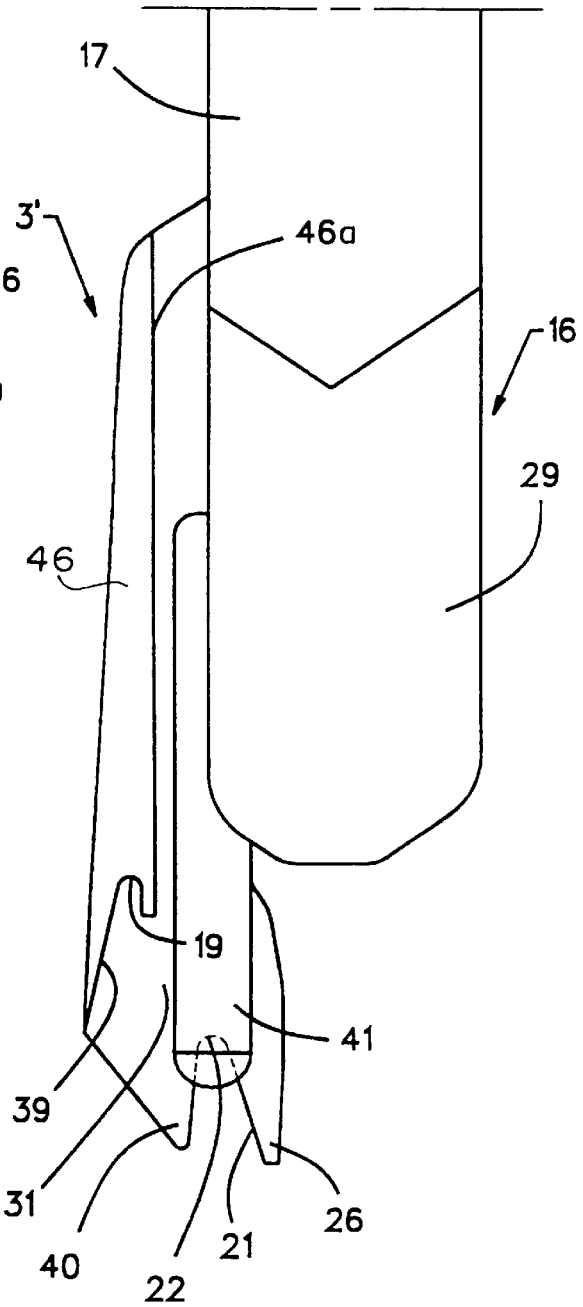
FIG. 16 is a view from below in the direction of the arrow F16 of FIG. 15.
Figure 6:
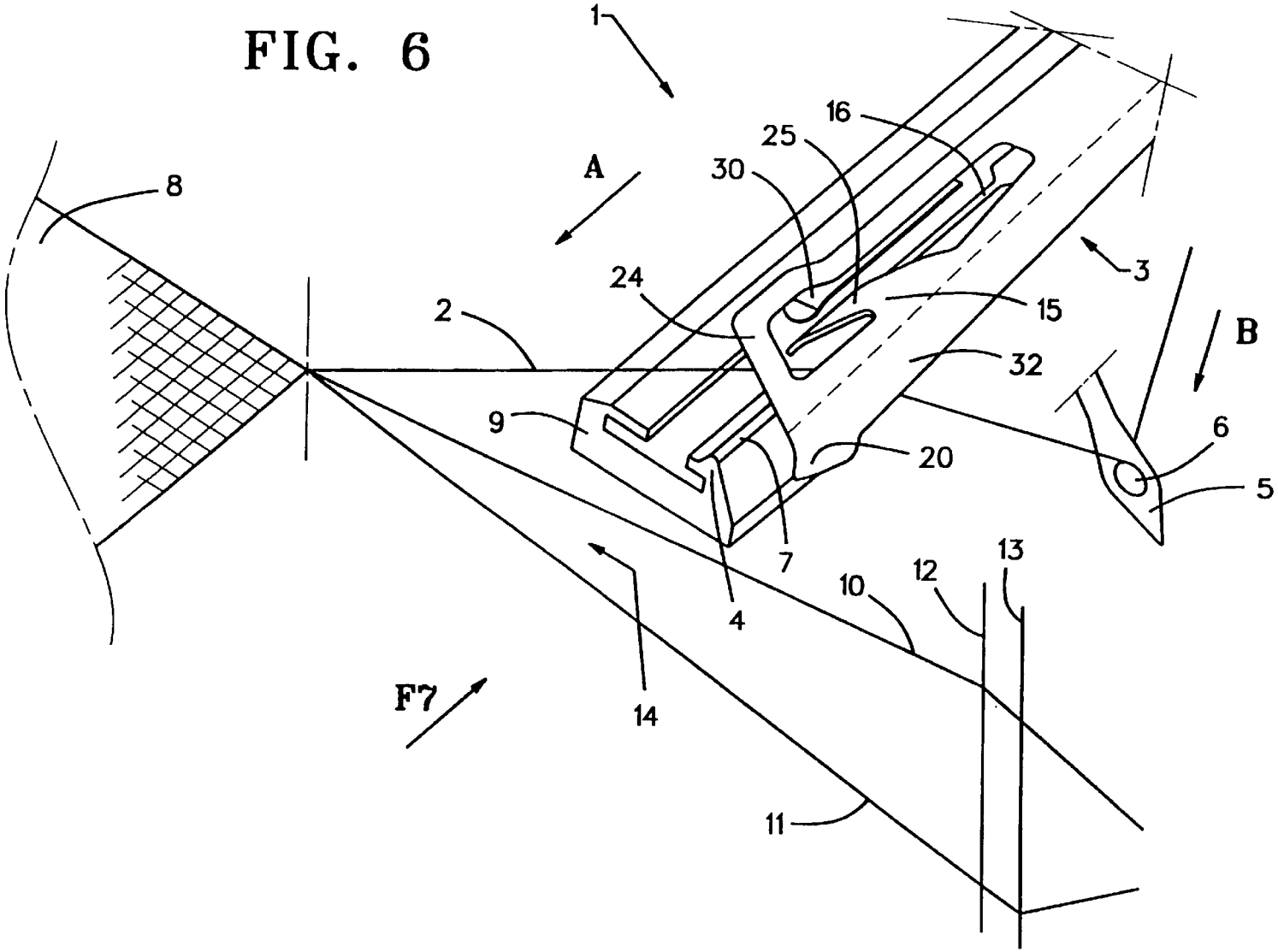
FIG. 6 is a view similar to that of FIG. 1 for an advanced position of the drawing gripper.
Figure 14:
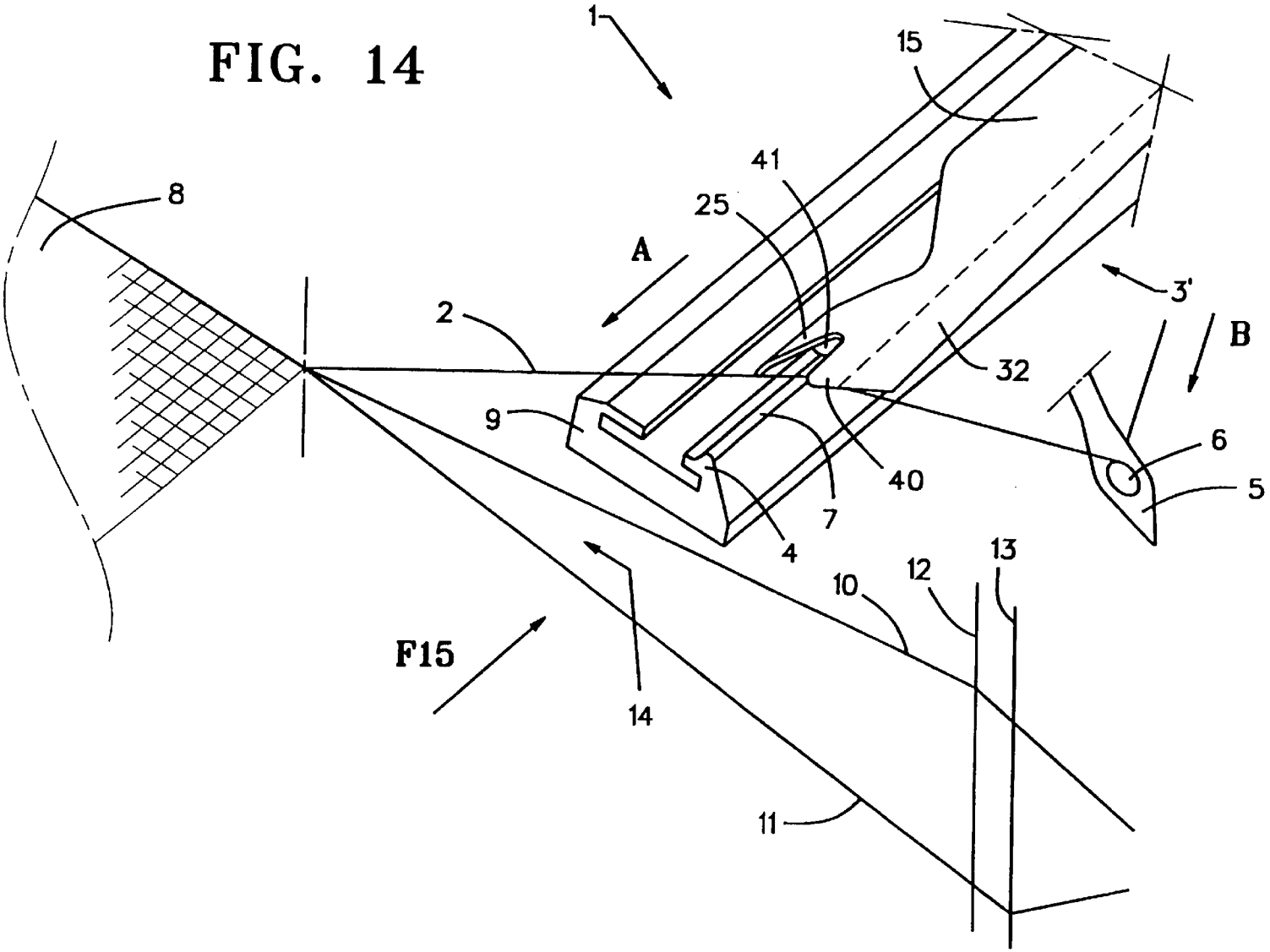
FIG. 14 is a perspective similar to that of FIG. 1 of a further embodiment variation.
Figure 15:
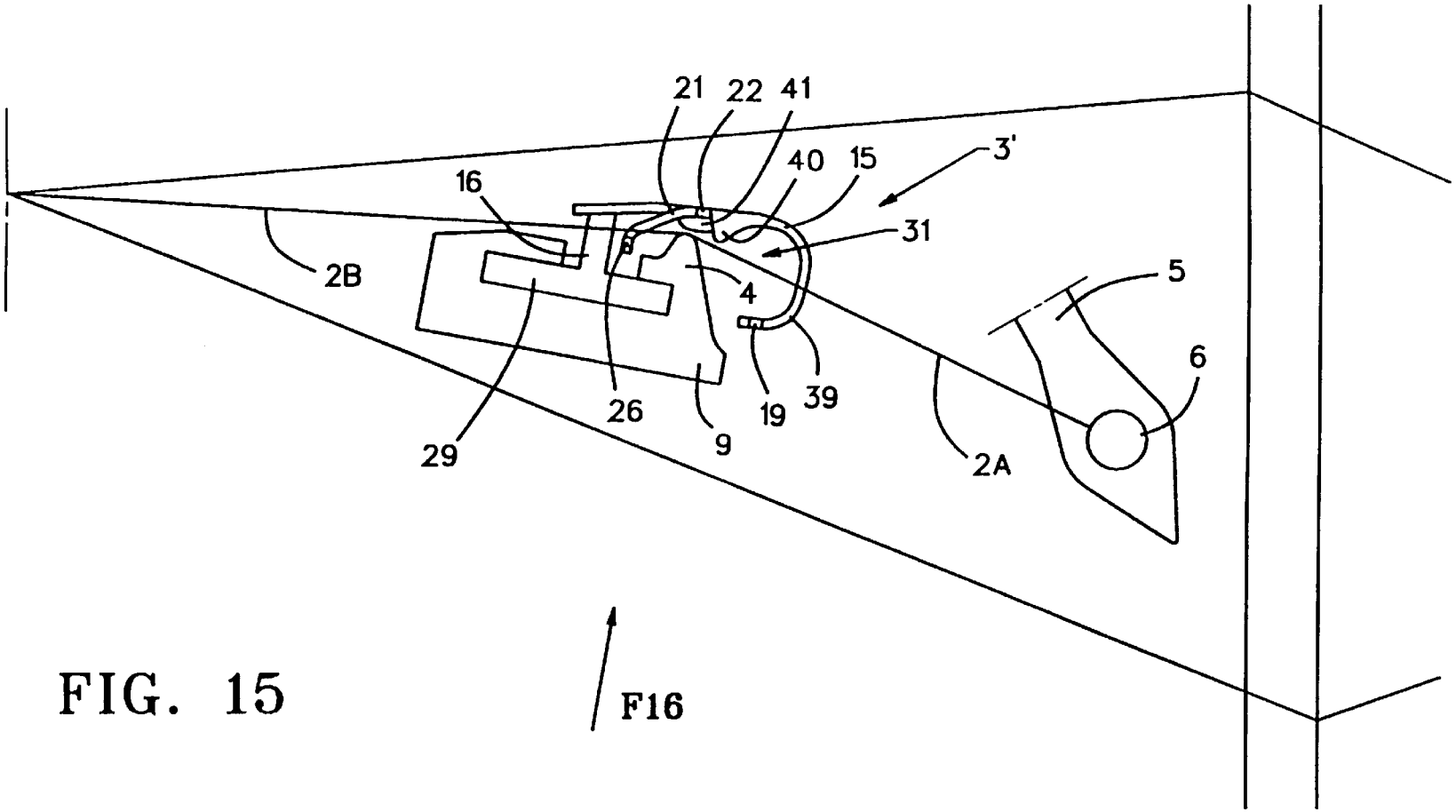
FIG. 15 is a view in the direction of arrow F15 of FIG. 14.

The embodiment of the drawing gripper 3' shown in FIGS. 14 through 16 operates on the same principle as the drawing gripper 3 discussed in relation to FIGS. 1 through 13, but its construction is different. This embodiment also comprises a U-bent plate 15 with a long leg above the deflecting edge 7 of the deflection guide 4 and with a short leg to the side of the deflection guide, said plate subtending a cavity 31 entered in such manner by the deflecting edge 7 of the deflection guide 4 that the filling 2 is seated on both sides of the deflection guide 4. In this embodiment the crossbar 32 of the U-shaped plate is shorter than the upper leg and therefore the guide surface 39 acting as a receiving element essentially begins at the upper edge of the crossbar and then runs to a positioning device in the form of a clearance 19 in the short leg. The upper leg forms a tip 40 somewhat bent inward toward the cavity to preclude catching warps. A lip 25 is bent inward from the long leg and forms a tip 26 fitted with a guide surface 21 acting as filling-receiving element and leading to a clearance 22 acting as filling-positioning device. The embodiment of FIGS. 14 through 16 furthermore provides that the yarn clamp shall clamp the filling in the vicinity of the positioning clearance 22 against the underside of the long leg of the plate 15. In this embodiment, the clamp is a leaf spring strip affixed to the inside of the long leg of the plate 15.

Figure 17:
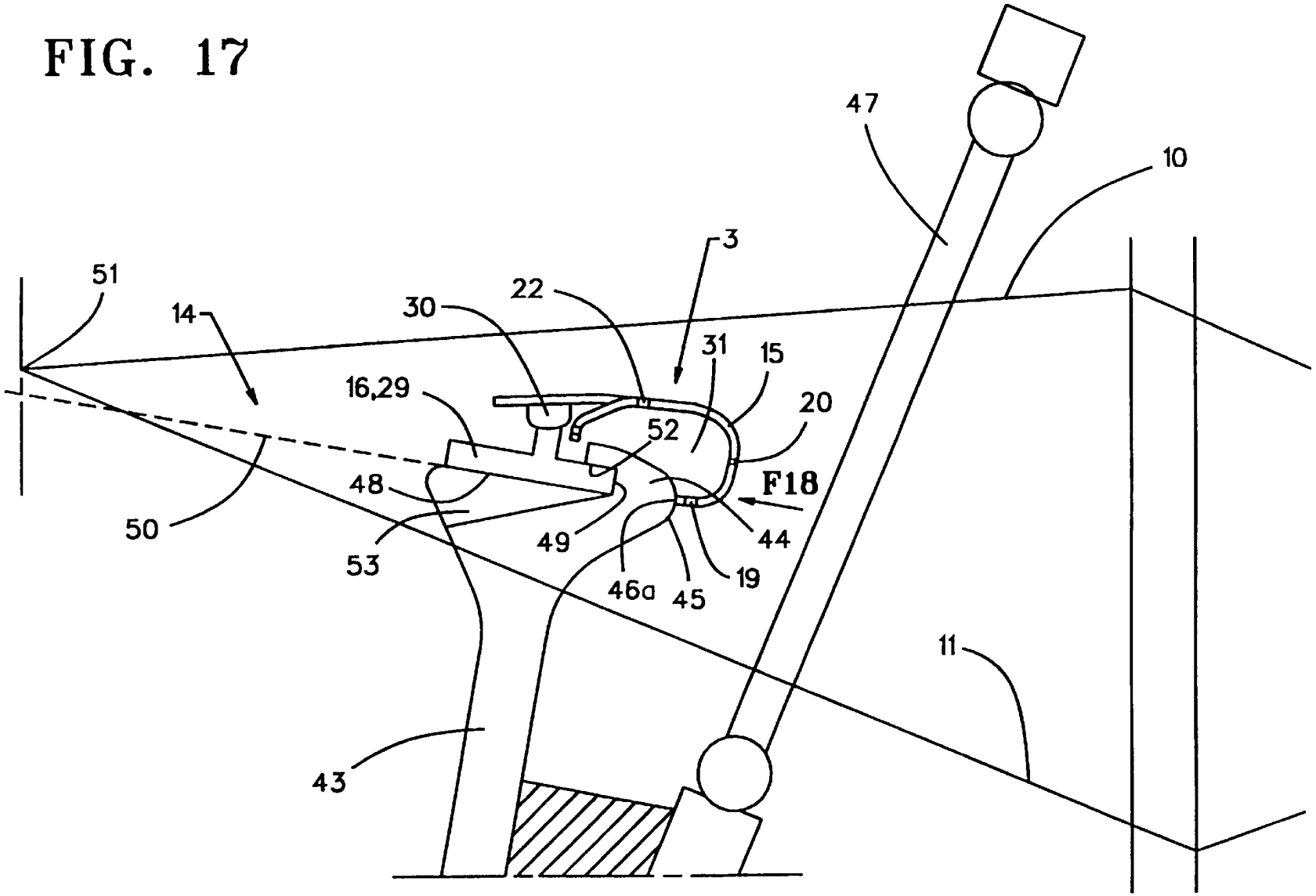
FIG. 17 is a view similar to FIG. 2 of an embodiment variation when the drawing gripper is already inside a shed.

It is known from U.S. Pat. 5,413,151 to use individual components to guide the rapier band 17 driving the drawing gripper 3 and if called for additionally also the support 16 connecting the drawing gripper to the rapier band 17 inside the shed 14. Such guide components 43 are shown in illustrative form in FIGS. 17 and 18. These guide components are mounted to a batten that also carries the reed 47, are equidistantly distributed across the weaving width and can be displaced by the warp sheet 11 of the lower shed into the shed 14. In this embodiment the guide components 43 comprise a guide surface 48 associated with the underside of the base 29 of the support 16 and the underside of the rapier band 17 and running across the full underside. Moreover these components comprise a hook-shaped extension 44 which forms a guide surface 49 for the side edge of the base 29 of the support 16 facing the reed 47 and/or the rapier band 17 as well as a guide surface 52 for the top side of the base 29 adjoining the respective side surface and/or the rapier band 17. As shown in particular by FIGS. 17 and 18, the guide components taper by means of bevels 53 in the vicinity of the blade-shaped guide surface 48 and with oblique surfaces 54 in the vicinity of the hook-shaped extension 44 in order to facilitate entry into the shed 14 by the warp sheet 11. The bevels 53 form a tip pointing at the beatup line 51. FIG. 17 shows that the plane 50 containing the guide surfaces 48 of the guide components 43 lies somewhat below the beatup edge 51, that is the edge of a fabric against which the reed 47 beats an inserted filling.

Figure 18:
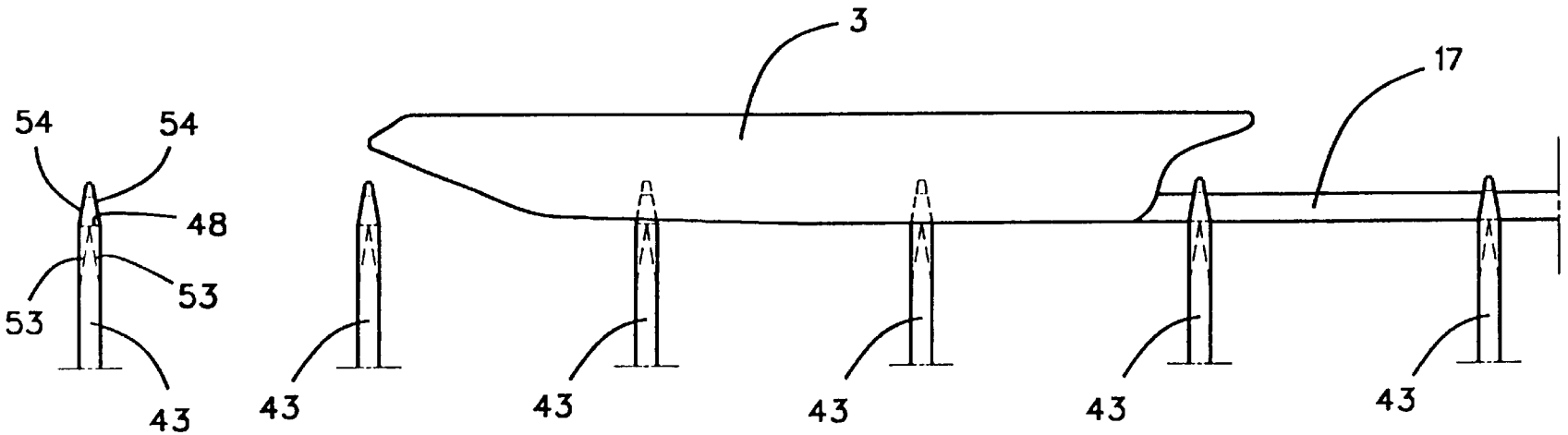
FIG. 18 is a view in the direction of the arrow F18 of FIG. 17.

In the embodiment shown in FIGS. 17 and 18, the drawing gripper 3 of the embodiment of FIGS. 1 through 13 or the drawing gripper 3' of FIGS. 14 through 16 are fitted with a guide surface 46*a* on the inner side of the short bottom leg 46 whereby such a drawing gripper is externally guided at an outside surface 45 of the guide components 43. In this embodiment the guide surface 46*a* is in the form of a segment of the short leg 46 of the U-shaped plate adjoining the positioning clearance 19 and illustratively shown in FIGS. 5 and 16. As shown in particular in FIG. 17, this guide surface 46 is opposite the side edge of the rapier band 17 and/or the base 29 of the support 16 and as a result the rapier band is guided in substantially a geometrically constrained manner in the zone of the drawing gripper 3. The extension 44 of the guide components 43 enters the cavity 31 of the drawing gripper 3.

Any wear between the guide surface 46*a* of the drawing gripper 3 and the outside 45 of the guide components is minimized in an embodiment variation whereby the short leg 46 of the plate 15 forming the guide surface 46*a* is fitted with a coating or a slide strip consisting of a wear-resistant and low-friction material.

Figure 19:
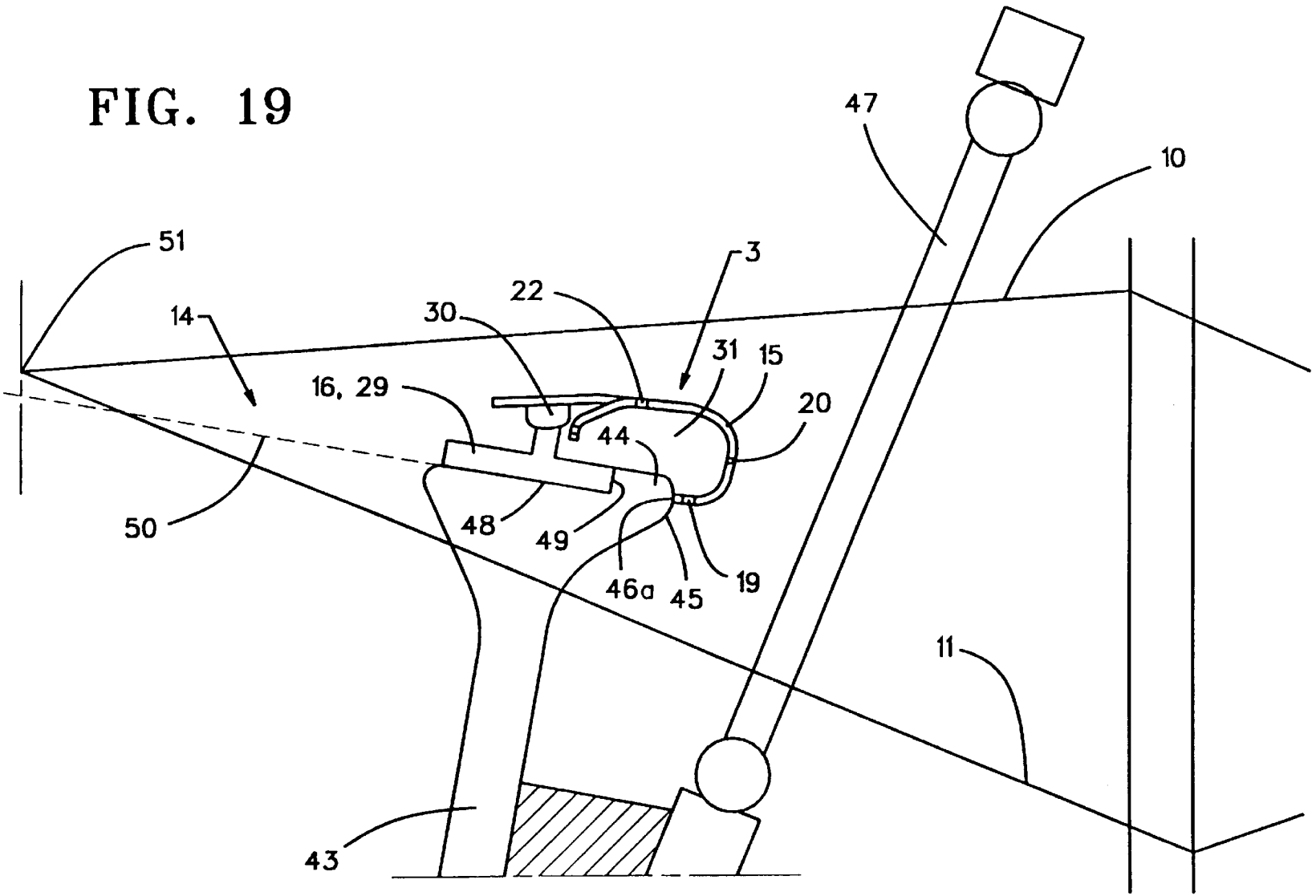
FIG. 19 is a view similar to FIG. 17 of an embodiment variation.

In the embodiment variation shown in FIG. 19, the guide surface 52 associated with the top side of the rapier band 17 and the base 29 of the support 16 is absent from the extensions 44 of the guide components 43.

The invention is not restricted to the embodiments shown and discussed above. Variations and in particular combinations of the particular embodiments are quite conceivable. The patent claims alone determine the scope of protection.

What is claimed is:

1. A drawing gripper for a rapier loom including elements for receiving and devices for positioning a filling to be inserted into a loom shed, wherein:

said gripper including walls configured to define a longitudinal cavity extending from its forward end facing its direction of motion when inserting a filling to its opposed rearward end, whereby in use said cavity may face towards and at least partially enclose a loom deflection guide that supports and presents a filling to the gripper during loom operation;

said gripper is a generally U-shaped plate having a substantially horizontal upper leg and a substantially horizontal lower leg;

said upper leg which is adapted to be fixable to a rapier band by a support element, is provided with a positioning device adapted for positioning a filling in the form of an inwardly bent lip; and said lower leg is provided with a second positioning device adapted for positioning a filling at its edge.

2. The drawing gripper as claimed in claim 1, wherein said elements for receiving a filling are located on different walls of said gripper defining the cavity.

3. The drawing gripper as claimed in claim 1, wherein said devices for positioning the filling are located on different walls of said gripper defining the cavity.

4. The drawing gripper as claimed in claim 1, wherein said elements for receiving the filling are longitudinally spaced from each other along the direction of insertion motion of the gripper.

5. The drawing gripper as claimed in claim 1, wherein said devices for positioning the filling are longitudinally spaced from each other along the direction of insertion motion of the gripper.

6. The drawing gripper as claimed in claim 1, wherein said elements for receiving the filling are longitudinally spaced from each other along the direction of insertion motion of the gripper, and said position devices for positioning the filling are longitudinally spaced from each other along the direction of insertion motion of the gripper.

7. The drawing gripper as claimed in claim 1, wherein one of said positioning devices is defined at least in part by the lip extending inwardly and downwardly into the cavity, said lip including a rearwardly and upwardly sloping guide surface defining one of said filling receiving elements, said guide surface extending to one of said positioning devices.

8. The drawing gripper as claimed in claim 7, including a yarn clamp mounted on the drawing gripper between an edge of fabric being woven and said one of said positioning devices.

9. The drawing gripper as claimed in claim 1, wherein said walls of said gripper are configured as said generally U-shaped plate enclosing said cavity on three sides, said plate including said upper leg, a side leg, and said lower leg, said lower leg being shorter than the upper leg.

10. The drawing gripper as claimed in claim 9, wherein said receiving elements are located on said upper leg and said lower leg.

11. The drawing gripper as claimed in claim 9, including a yarn clamp mounted on the upper leg of the gripper; one of said positioning devices is located along the upper leg; and another positioning device is located along the lower leg.

12. The drawing gripper as claimed in claim 9, including a lip extending inwardly and downwardly from the upper leg into the cavity, said lip including a rearwardly and upwardly sloping guide surface defining one of said filling receiving elements, said guide surface extending to a clearance defining one of said positioning devices.

13. The drawing gripper as claimed in claim 9, said side leg extending to a forward end of the gripper and extending forwardly of the top leg at the forward end of the gripper to define a tapered forward tip of the gripper.

14. The drawing gripper as claimed in claim 13, said forward tapered tip of said side leg including a downwardly and rearwardly sloping guide surface defining one of said elements for receiving a filling, said guide surface terminating at a clearance in the lower leg defining one of said positioning devices.

15. The drawing gripper as claimed in claim 9, including gripper guide elements along which the gripper is guided in the loom, said guide elements including respective gripper guide surfaces; said lower leg of said gripper walls including a lower guide surface located so as to engage a portion of said gripper guide surfaces during weft insertion motion of the gripper; and a gripper support connected to the gripper and engageable with another portion of the gripper guide surfaces of the guide elements.

16. The drawing gripper as claimed in claim 15, wherein said lower leg includes one of said positioning devices and said lower guide surface is located rearwardly of said one positioning device relative to the direction of insertion motion of the gripper.

17. A drawing gripper for a rapier loom including elements for receiving and devices for positioning a filling to be inserted into a loom shed, in combination with a deflection guide, wherein:

said gripper including walls configured to define a longitudinal cavity extending from its forward end facing its direction of motion when inserting a filling to its opposed rearward end, whereby in use said cavity may face towards and at least partially enclose a loom deflection guide that supports and presents a filling to the gripper during loom operation;

said gripper is a generally U-shaped plate having a substantially horizontal upper leg and a substantially horizontal lower leg;

said upper leg which is adapted to be fixable to a rapier band by a support element, is provided with a positioning device adapted for positioning a filling in the form of an inwardly bent lip;

said lower leg is provided with a second positioning device adapted for positioning a filling at its edge; and said gripper is adapted to be moveable by said rapier band along a guide structure during filling insertion, and said deflection guide is securable to said guide structure.

18. A drawing gripper for a rapier loom including elements for receiving and devices for positioning a filling to be inserted into a loom shed, in combination with a deflection guide, wherein:

said gripper including walls configured to define a longitudinal cavity extending from its forward end facing its direction of motion when inserting a filling to its opposed rearward end, whereby in use said cavity may face towards and at least partially enclose a loom deflection guide that supports and presents a filling to the gripper during loom operation;

said gripper is a generally U-shaped plate having a substantially horizontal upper leg and a substantially horizontal lower leg;

said upper leg which is adapted to be fixable to a rapier band by a support element, is provided with a positioning device adapted for positioning a filling in the form of an inwardly bent lip;

said lower leg is provided with a second positioning device adapted for positioning a filling at its edge; and said deflection guide is adapted to support a filling in readiness for being received by said gripper, said cavity facing towards and partially enclosing said deflection guide.

19. The drawing gripper in combination with a deflection guide as claimed in claim 18, wherein one of said positioning devices is defined at least in part by a lip extending inwardly and downwardly into the cavity towards a side of the deflection guide facing towards an edge of fabric being woven, said lip including a rearwardly and upwardly sloping guide surface defining one of said filling receiving elements, said guide surface extending to one of said positioning devices.

20. The drawing gripper in combination with a deflection guide as claimed in claim 18, wherein said walls of said gripper are configured as a generally U-shaped plate enclosing said cavity on three sides, said plate including an upper leg located above the deflection guide, a side leg located to one side of the deflection guide facing away from an edge of fabric being woven, and a lower leg extending toward the deflection guide.

21. The drawing gripper in combination with a deflection guide as claimed in claim 18, wherein said receiving elements are located on opposite sides of said deflection guide.

* * * * *